US011313089B2

(12) United States Patent
Wenger

(10) Patent No.: US 11,313,089 B2
(45) **Date of Patent: *Apr. 26, 2022**

(54) TERMINAL ELEMENT OF A TRAFFIC BARRIER DEVICE, TRANSITION SYSTEM, AND METHOD FOR PROVIDING IMPACT PROTECTION

(71) Applicant: WENGER, PROJEKTE UND COACHING, Morgarten (CH)

(72) Inventor: Hermann Wenger, Morgarten (CH)

(73) Assignee: Wenger, Projekte und Coaching, Morgarten (CH)

( * ) Notice: Subject to any disclaimer, the term of this patent is extended or adjusted under 35 U.S.C. 154(b) by 170 days.

This patent is subject to a terminal disclaimer.

(21) Appl. No.: 16/628,054

(22) PCT Filed: Jul. 12, 2017

(86) PCT No.: PCT/EP2017/067551

§ 371 (c)(1),
(2) Date: Jan. 2, 2020

(87) PCT Pub. No.: WO2019/011424

PCT Pub. Date: Jan. 17, 2019

(65) Prior Publication Data

US 2020/0173123 A1 Jun. 4, 2020

(51) Int. Cl.
*E01F 15/12* (2006.01)
*E01F 15/14* (2006.01)

(52) U.S. Cl.
CPC ..... *E01F 15/12* (2013.01); *E01F 15/146* (2013.01)

(58) Field of Classification Search
CPC ..... E01F 15/12; E01F 15/146
See application file for complete search history.

(56) References Cited

U.S. PATENT DOCUMENTS 4,923,327 A * 5/1990 Gorlov ..... E01F 13/046 404/6
5,551,796 A * 9/1996 Anderson, Jr ..... E01F 15/12 256/13.1

(Continued)

FOREIGN PATENT DOCUMENTS

DE 25 23 291 A1 5/1976
DE 600 14 502 T2 2/2006

(Continued)

OTHER PUBLICATIONS

International Search Report Corresponding to PCT/EP2017/067554 dated Apr. 12, 2018.

(Continued)

*Primary Examiner* — Abigail A Risic
(74) *Attorney, Agent, or Firm* — Finch & Maloney PLLC; Michael J. Bujold; Jay S. Franklin

(57) ABSTRACT

A terminal element (100) of a traffic barrier device (1), having a longitudinal axis, comprising a guide element (10) and an impact element (20). The impact element (20) is pivotally mounted on the guide element (10) about a vertical axis (A) so as to be rotatable or pivotable about a vertical axis. The impact element has a connecting side, for connection to an adjacent traffic barrier device, and an impact side, for damping or repelling an impact. The vertical axis is arranged between the connecting side and the impact side.

19 Claims, 6 Drawing Sheets

(56) References Cited

U.S. PATENT DOCUMENTS

Figure 1:
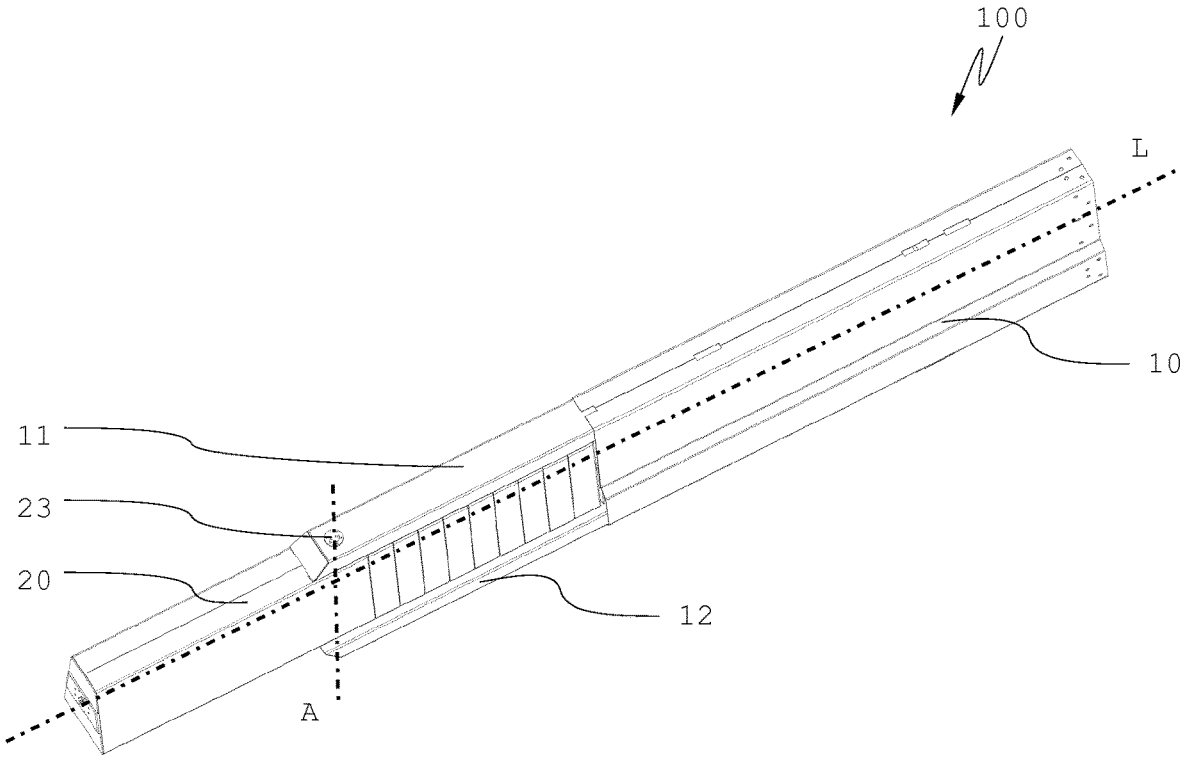

| | | | | |
|---|---|---|---|---|
| 6,059,487 | A * | 5/2000 | Haga | E01F 15/0476 256/13.1 |
| 6,402,421 | B1 * | 6/2002 | Ottavi | E01F 15/006 256/13.1 |
| 6,413,009 | B1 * | 7/2002 | Duckett | E01F 15/083 404/6 |
| 7,393,154 | B1 * | 7/2008 | Dyke | E01F 15/085 256/13.1 |
| 9,945,084 | B1 * | 4/2018 | Warford | E01F 15/146 |
| 2008/0118305 | A1 * | 5/2008 | Carey | E01F 15/025 404/6 |
| 2009/0060650 | A1 * | 3/2009 | Kulp | E01F 15/086 404/6 |
| 2012/0207541 | A1 * | 8/2012 | Maus | E01F 13/00 404/6 |

FOREIGN PATENT DOCUMENTS

| | | | |
|---|---|---|---|
| EP | 2 784 222 | A1 | 10/2014 |
| KR | 101 613 275 | B1 | 4/2016 |
| WO | 2014/127763 | A2 | 8/2014 |
| WO | 2017/118620 | A1 | 7/2017 |

OTHER PUBLICATIONS

International Search Report Corresponding to PCT/EP2017/067551 dated Apr. 12, 2018.
Written Opinion Corresponding to PCT/EP2017/067554 dated Apr. 12, 2018.
Written Opinion Corresponding to PCT/EP2017/067551 dated Apr. 12, 2018.

* cited by examiner

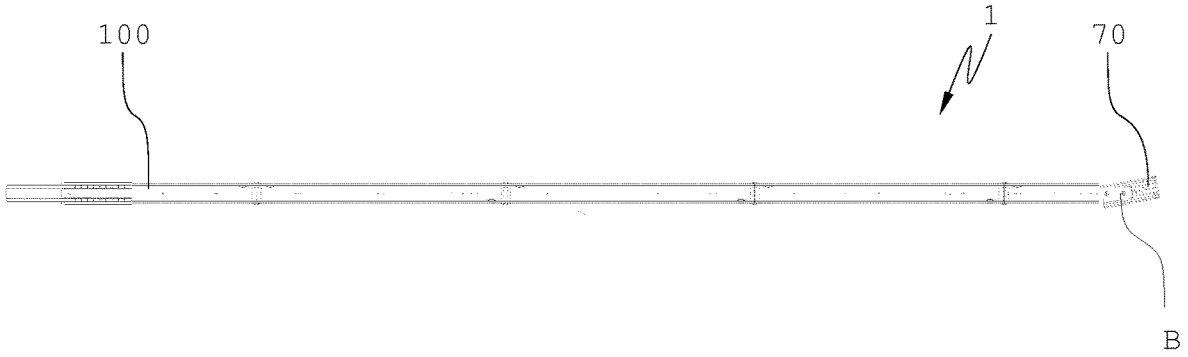
FIG 7
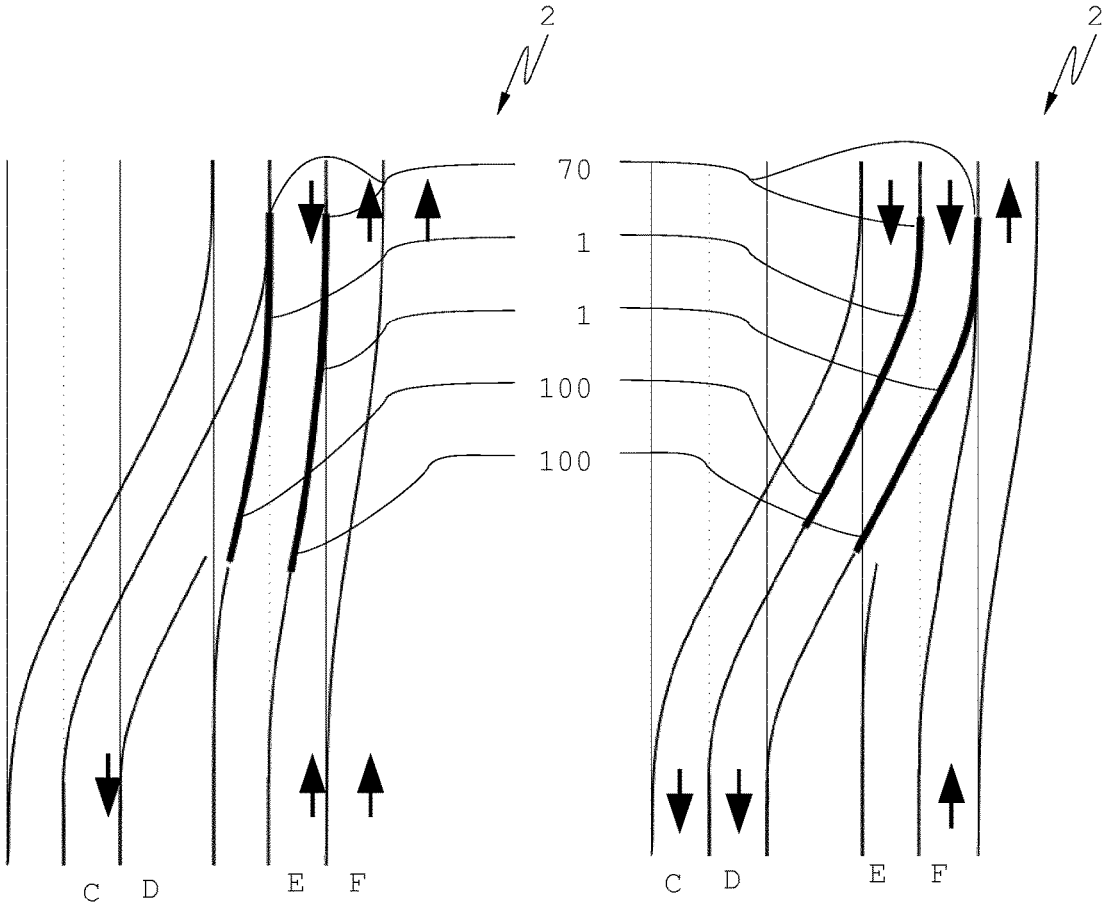
FIG 8a
FIG 8b

TERMINAL ELEMENT OF A TRAFFIC BARRIER DEVICE, TRANSITION SYSTEM, AND METHOD FOR PROVIDING IMPACT PROTECTION

The present invention relates to a terminal element of a traffic barrier device, a transition system comprising at least one traffic barrier device with a terminal element and a method for providing a collision protection at a terminal element of a traffic barrier device.

Various traffic barrier devices, colloquially also called crash barriers, are known from the state of the art. The purpose of roadway limitation is to keep the vehicle on the road in the event of an accident. However, generic traffic barrier devices should make it possible to provide a passage for emergencies or traffic, e.g. if the traffic has to be diverted.

For example, EP 2 784 222 B1 discloses a mobile crash barrier which is suitable for use in a transition system. A generic transition system is shown, for example, in DE 600 14 502 T2. Such a transition system is also shown in the PCT application PCT/EP 2017/050042, which has not yet been published. Typically, transition systems have two swiveling traffic barrier devices or crash barriers. The swiveling system can create a passageway that serves as a transition for the vehicles, for example from a first lane to a second lane.

The crash barrier device as shown in EP 2 784 222 has a flap element which can be lowered and can be described as a short turned-down terminal (a special form of standard turned-down terminal). This flap element is arranged at the front of the crash barrier device. The purpose of this short turned-down terminal is to provide collision protection if the crash barrier element is not arranged in line with another crash barrier element and there is a risk that a vehicle could collide with the crash barrier element at the end face. The end face comprises the area of a crash barrier element which closes off the crash barrier element along a longitudinal axis.

To ensure safety in the event of a vehicle colliding with the traffic barrier device, it is necessary for the traffic barrier device to absorb high longitudinal forces. To this end, state-of-the-art technology provides for individual elements of the crash barrier devices to be connected to each other in the operating state by means of a locking device.

The crash barrier device from EP 2 784 222 B1 does comprise such a locking mechanism. The mechanism is incorporated in the flap element, which makes a complex design necessary. When the flap element is actuated, high forces are also exerted, caused by torques. When connecting several crash barrier devices, high precision is required due to the flap element and the locking device arranged within in order to ensure complete locking.

It is therefore the object of the invention to eliminate these and other disadvantages of the state of the art. This object is solved by the devices and procedures defined in the independent patent claims. Further preferred embodiments are provided in the dependent patent claims.

According to the invention, a terminal element of a traffic barrier device, in particular a device for opening a passage in a traffic barrier device, with a longitudinal axis comprises a guiding element and an impact element. The impact element is rotatable or pivotable relative to the guiding element from a closed position into an impact position. The impact element is mounted on the guide element so that it can be rotated or pivoted about a vertical axis. The impact element has a connecting side for connection to an adjacent traffic barrier device and an impact side for damping or repelling an impact. The vertical axis is arranged between the connecting side and the impact side.

In generic use, in the impact position of the impact element, the impact side faces oncoming traffic. The impact side is specifically designed for the impact of a vehicle.

Preferably, the impact element has an essentially congruent or similar contour to the guiding element. The contours transverse to the longitudinal axis of the guiding element and the impact element are at least partially superposed both in the closed position and in the impact position, preferably the superposition in the closed position corresponds essentially to the superposition in the impact position.

The vertical axis is preferably arranged symmetrically in relation to the longitudinal axis in the terminal element.

This enables simple and uncomplicated production as well as simple assembly of the terminal element. In addition, forces on the impact element can be easily absorbed. A corresponding superposition of the contours in the impact position and in the closed position is ensured. Preferably, the impact element extends along the longitudinal axis both in the closed position and in the impact position.

This promotes force absorption in the longitudinal direction. Leverage effects are reduced or avoided.

Preferably, the impact element can be retained in the closed position and/or in the impact position.

Two defined positions make it possible to bring the impact element into two defined operating states. Calculation and construction therefore only have to be calculated in two preferred states. This allows for a simplified dimensioning of the elements.

The retaining device makes it possible to secure the impact element in the corresponding first or second position and, for example, to protect it against unintentional manipulation.

The impact element can comprise at least one first element of a retaining device.

This enables manufacturing a part of the retaining device as an integral part of the impact element. Design and operation are simplified. In addition, a good transmission of force to the impact element is possible.

The first element of the retaining device can preferably be designed as a retaining opening or as a retaining cylinder. These are proven elements of mechanical engineering and make it possible to provide a simple retaining mechanism.

Such a retaining cylinder is preferably designed as a lifting rotary cylinder. It moves from a first position to a second position and rotates about its cylinder axis in such a way that two or more extensions arranged on the cylinder engage in corresponding openings and interact as bayonet locks.

Preferably, a second element of the retaining device is arranged inside the guiding element.

The second element of the retaining device is thus protected against environmental influences.

The retaining device is preferably hydraulically operable.

Hydraulic actuators are low-maintenance and highly reliable. Since the individual elements in hydraulic devices can be connected by means of flexible lines, individual positioning of the hydraulic actuating device is possible. Space conditions, e.g. within the guiding element, can well exploited.

The impact element preferably comprises at least one first element of a locking device. This first element of the locking device may be in the form of a locking bolt or a cylinder. Such a cylinder is preferably designed as a lifting and rotating cylinder. It moves from a first position to a second position and rotates about its cylinder axis in such a way that two or more extensions arranged on the cylinder engage in corresponding openings and interact as bayonet locks.

This has the advantage that the first element of the locking device interacts reliably with the impact element.

Preferably the first element of the locking device is located inside the impact element. This enables reliable positioning and also reliable force transmission of the first element to the impact element. The impact element can be reliably bolted.

The design as a locking bolt or as a cylinder enables reliable and simple locking of the impact element. Both locking bolts and cylinders are easy to operate elements. Manipulation and locking of the impact element are thus simplified.

Preferably the first element of the locking device is located inside the impact element.

A reliable fastening of the first element of the locking device is possible, a reliable power transmission is guaranteed. In addition, the first element of the locking device can be protected from environmental influences.

Preferably the locking device can be operated hydraulically. As explained above, hydraulic actuators are reliable and easy to maintain.

The impact element may have an impact absorber on the impact side. An impact absorber is one of several forms of impact protection. The impact side is thus specifically designed for the impact of a vehicle.

An impact absorber makes it possible to protect the occupants of the vehicle in the event of a collision between a vehicle and the terminal element. An impact absorber converts the kinetic energy into deformation energy and dissipates it. The vehicle that collides with the impact absorber is thus slowed down.

The impact absorber can be designed in several parts and preferably comprise several crumple elements.

This enables building the impact absorber in a modular way and/or to replace the corresponding crumple elements which have actually been used after an accident. For example, a collision at slow speed deforms only the first of several crumple elements arranged in a row.

The crumple elements preferably have different compression properties or a different working capacity.

The impact absorber can therefore be designed with the desired properties, for example progressive compression properties. In the event of an impact, the deceleration curve can be individually adjusted.

It is also conceivable that the impact element comprises a turned-down terminal, for example a short turned-down terminal or also a standard turned-down terminal. Typically, a turned-down terminal at the impact element is shorter than a short turned-down terminal. This is typically due to the shorter design and mobile use. The turned-down terminal is also one of several forms of collision protection. The impact side is thus specifically designed for the impact of a vehicle. In contrast to the impact element, the vehicle, which collides with a crash barrier with a turned-down terminal, is not compressed frontally, but jacked up.

The terminal element can therefore be equipped with a desired impact element, depending on its purpose.

Preferably the first element of the locking device is arranged opposite the impact absorber or the turned-down terminal with respect to the vertical axis.

A clean separation of impact protection (impact absorber/turned-down terminal) and bolting device is thus possible. This arrangement also makes it possible to arrange either the impact protection or the bolting device on the front end of the terminal element by a simple 180° rotation or pivoting about the vertical axis, i.e. to bring either the closing side or the impact side into an intended position, namely the closed position or the impact position.

The impact element is preferably arranged at least partially and in particular in the closed position within the guiding element. The impact element is thus at least partially protected.

The guiding element can comprise two legs between which the impact element is arranged. Preferably, the vertical axis extends between the legs of the guiding element.

The arrangement of the impact element between the legs makes enables arranging of the impact element as an integral part of the terminal element. As the vertical axis may extend between the legs, the impact element may rotate within these two legs. A suspension of the impact element on two legs enables a high stability of the impact element in relation to the guiding element. In addition, simple production is possible.

The impact element can preferably be moved horizontally along the longitudinal axis of the terminal element. This makes it possible to change or adjust the overall length of the terminal element.

Preferably a damper is arranged between the impact element and the guide element for damping a horizontal movement of the impact element. The damper is preferably designed as one or more oil or air dampers. Two oil or air dampers are preferred.

This enables absorbing additional energy when a vehicle hits the impact element.

The impact element then moves with the force applied to the impact element in the longitudinal direction of the terminal element and thus in the longitudinal direction of the traffic barrier element, along the longitudinal axis. A damper can be used to decelerate this vehicle together with the impact element over a longer distance.

If the impact element is in a position in which the impact absorber is arranged on the end face of the terminal element, a so-called superposition of the damping curves of the impact element and the damper takes place between the guiding element and the impact element. The deceleration of a vehicle takes place over a longer distance, which leads to a reduced deceleration, which in turn leads to a reduced force effect on the occupants of the vehicle. This increases safety.

The terminal element can have a traction drive to swivel the impact element. This enables the impact element to be swiveled easily and safely.

A further aspect of the invention relates to a transition system comprising at least one traffic barrier device with a terminal element as described above.

This provides for a complete traffic control and guidance system.

The traffic barrier device of the transition system may have a second vertical axis of rotation on a side remote from the terurinal element for pivoting the traffic barrier device relative to a stationary or fixed element of the transition system.

On the one hand, this enables the fixed connection of the traffic barrier device with a stationary element, on the other hand it is also possible to swivel this element in relation to a fixed element. A device or running gear for swiveling such a traffic barrier device is described, for example, in the international patent application PCT/EP2017/050042. The traffic barrier device described herein and/or the terminal element described herein may be fitted with a running gear, preferably a running gear described in the aforementioned international patent application.

A further aspect of the invention relates to a method for providing a collision protection on a terminal element of a traffic barrier device, in particular on a terminal element described herein or on a terminal element of a transition system described herein. The impact protection is swiveled about a vertical axis arranged on the guide element and, in particular, rotated or swiveled from a closed position into an impact position. Preferably the impact protection is part of an impact element as described herein.

The impact protection can be designed as an impact element or as a turned-down terminal device.

Horizontal swiveling about a vertical axis enables the collision protection to be moved from a protected position, for example within a guide element, to a second position (operating position).

In a first step of the process, a locking device can be released, which is arranged inside the guide element in particular. In a second step, a bolting device can be released. The bolting device is preferably arranged inside an impact element which has the impact protection.

Preferably, after pivoting the impact element, the impact element is locked with a locking device to a further traffic barrier device in such a way that the impact element is fixed under pre-stress.

This makes it possible to produce a reliable traffic barrier device. In a further step it is also conceivable to retain the impact element with a retaining device on the guide element in such a way that further pivoting of the impact element is prevented. This allows the impact element to be brought into a stable position. The terminal element is therefore stable overall.

Figure 2:
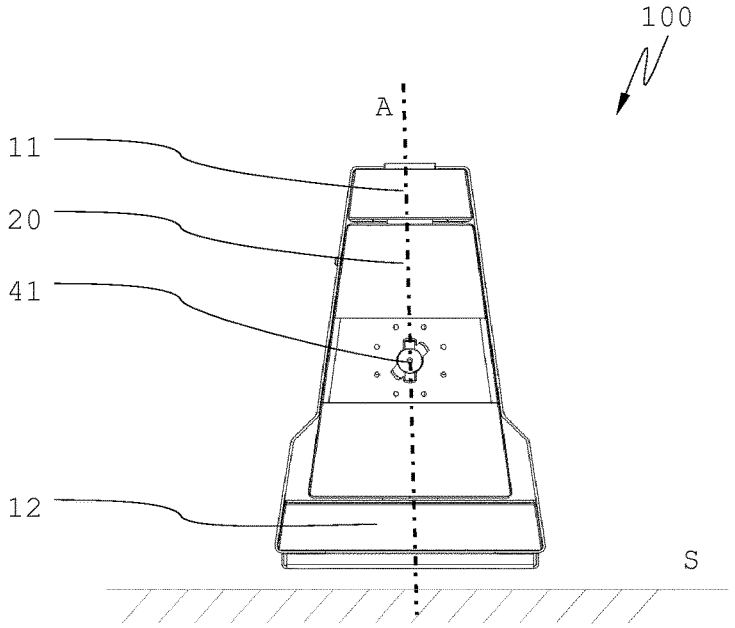
Figure 3:
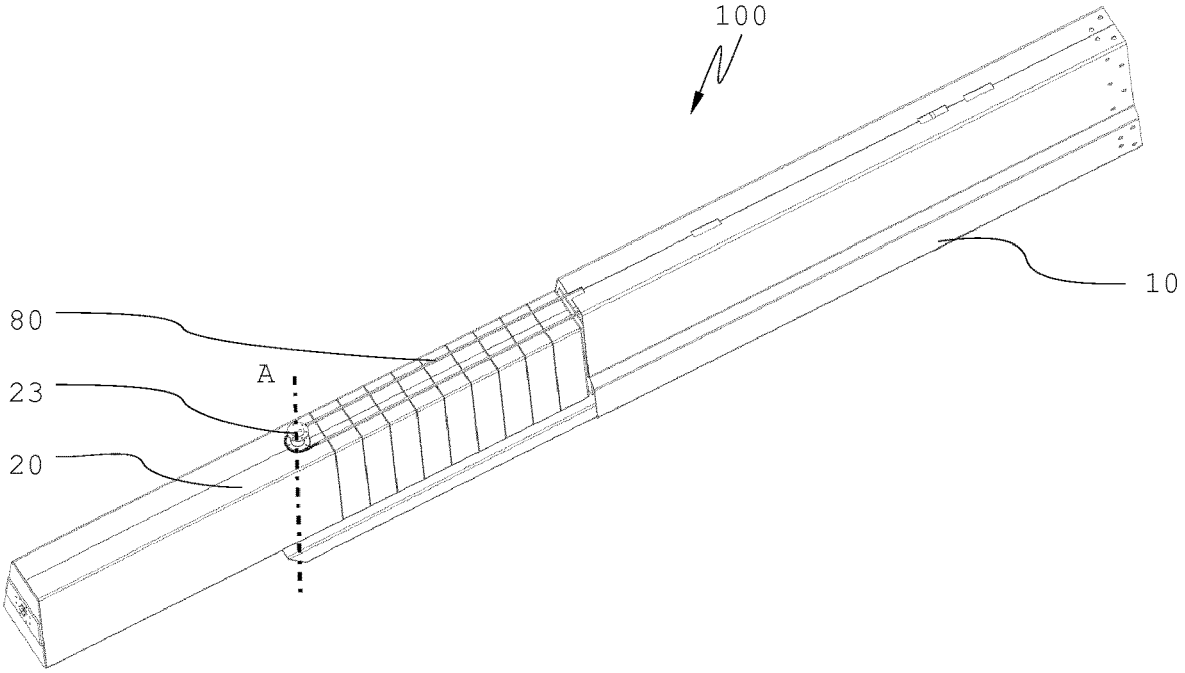
Figure 4:
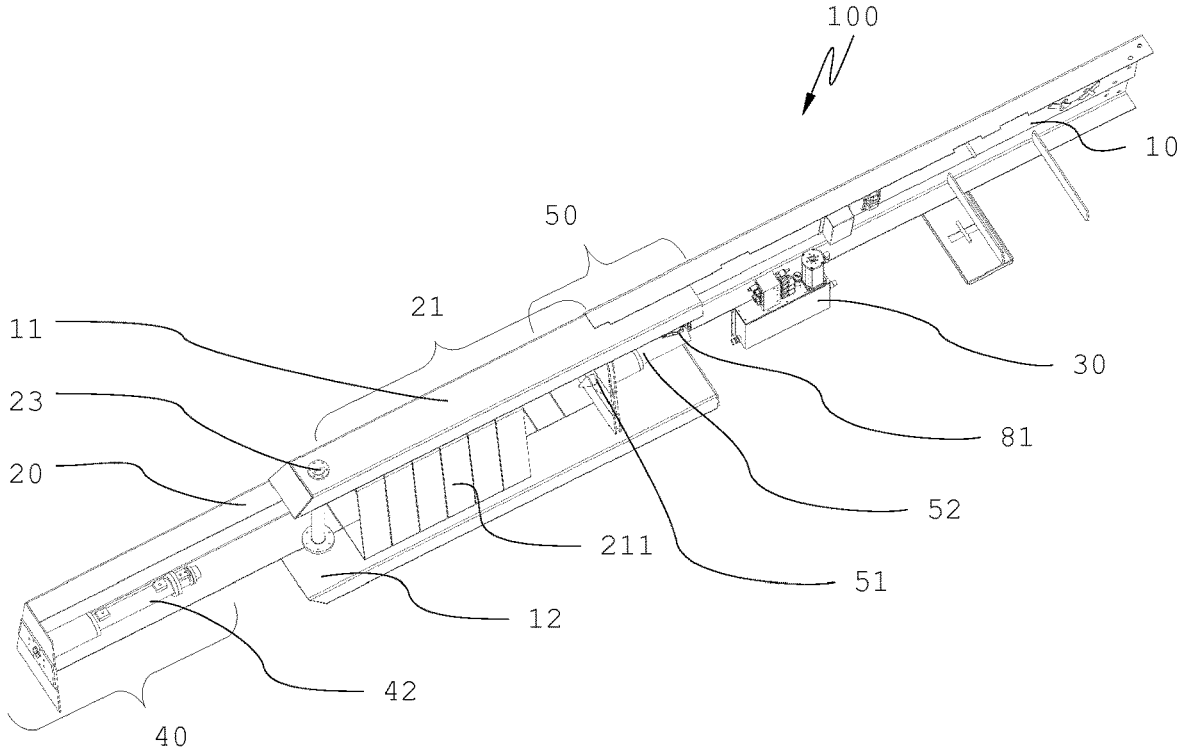
Figure 5:
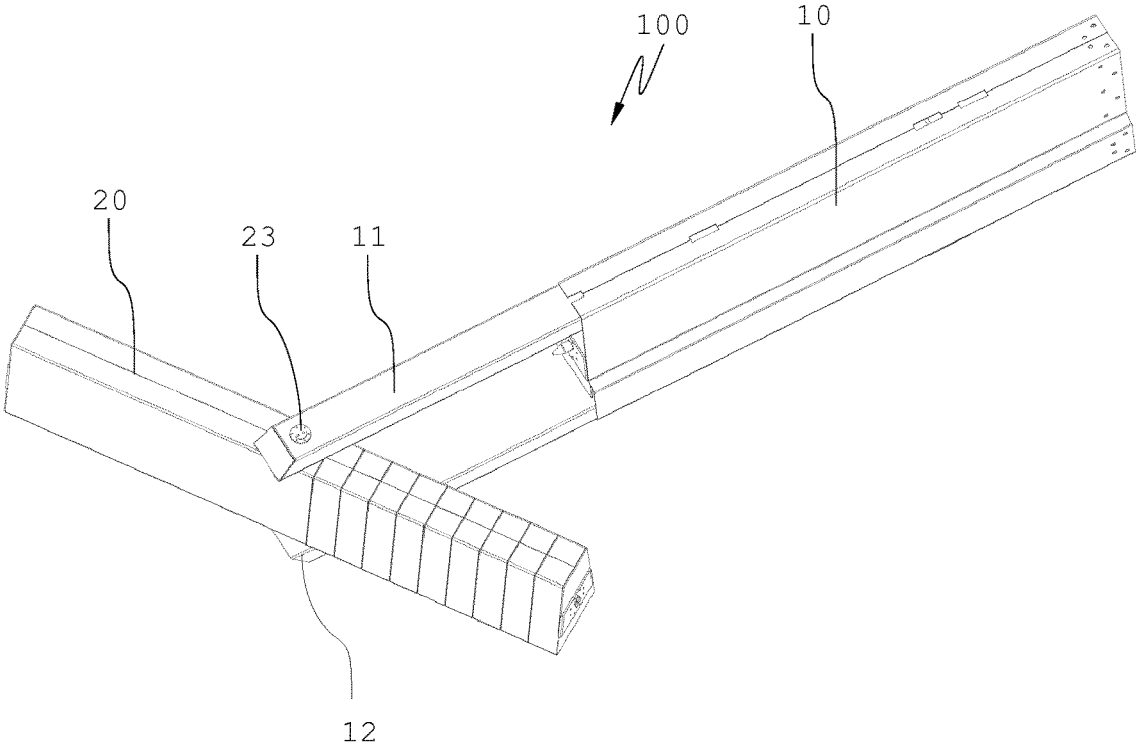
Figure 6:
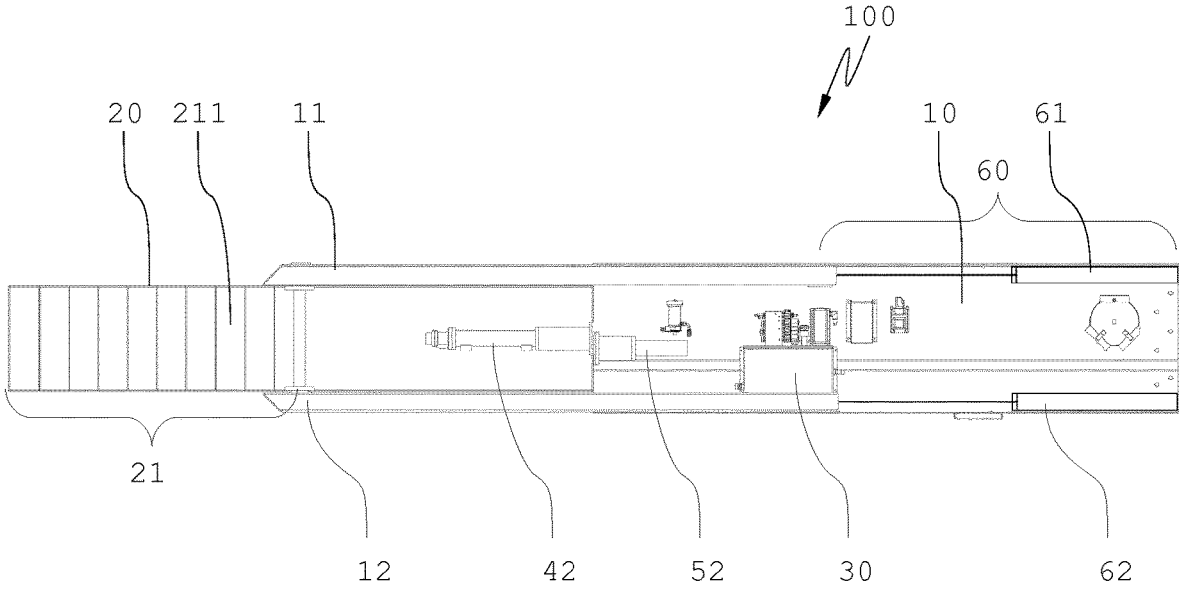
Figure 9:
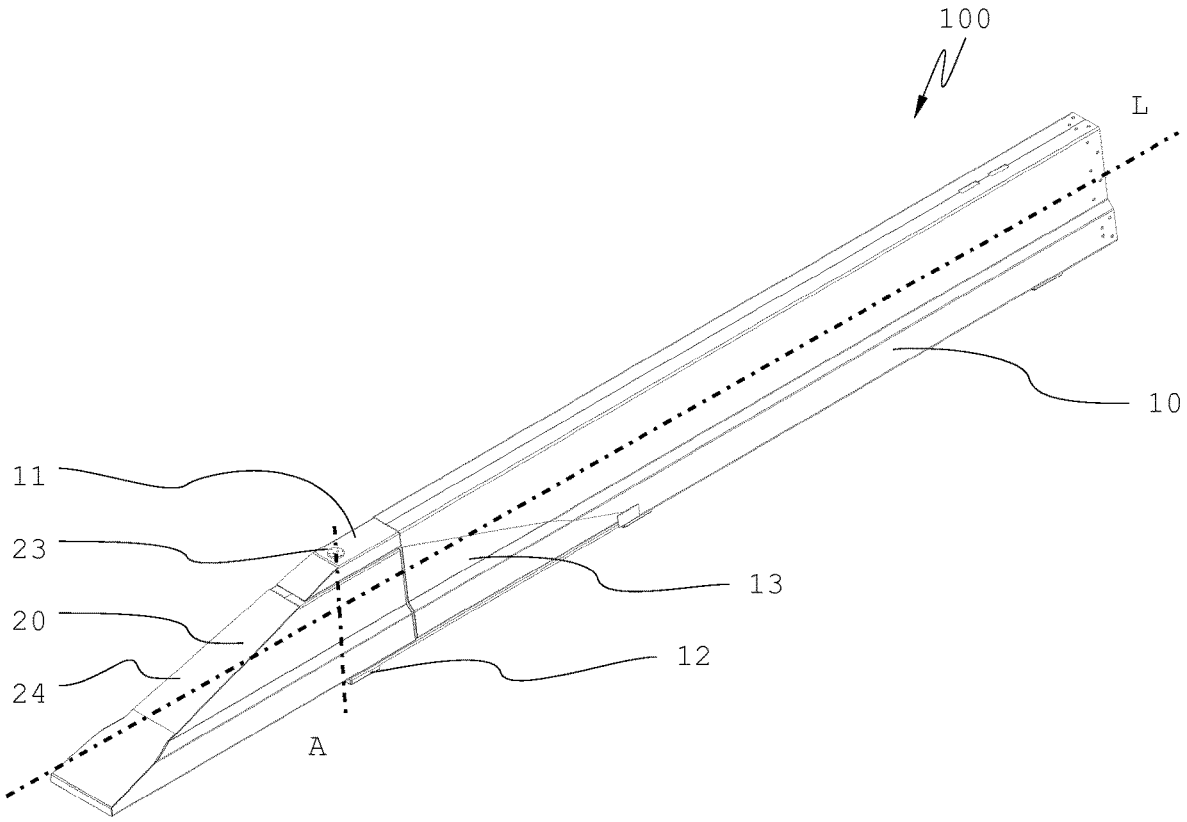
Figure 10:
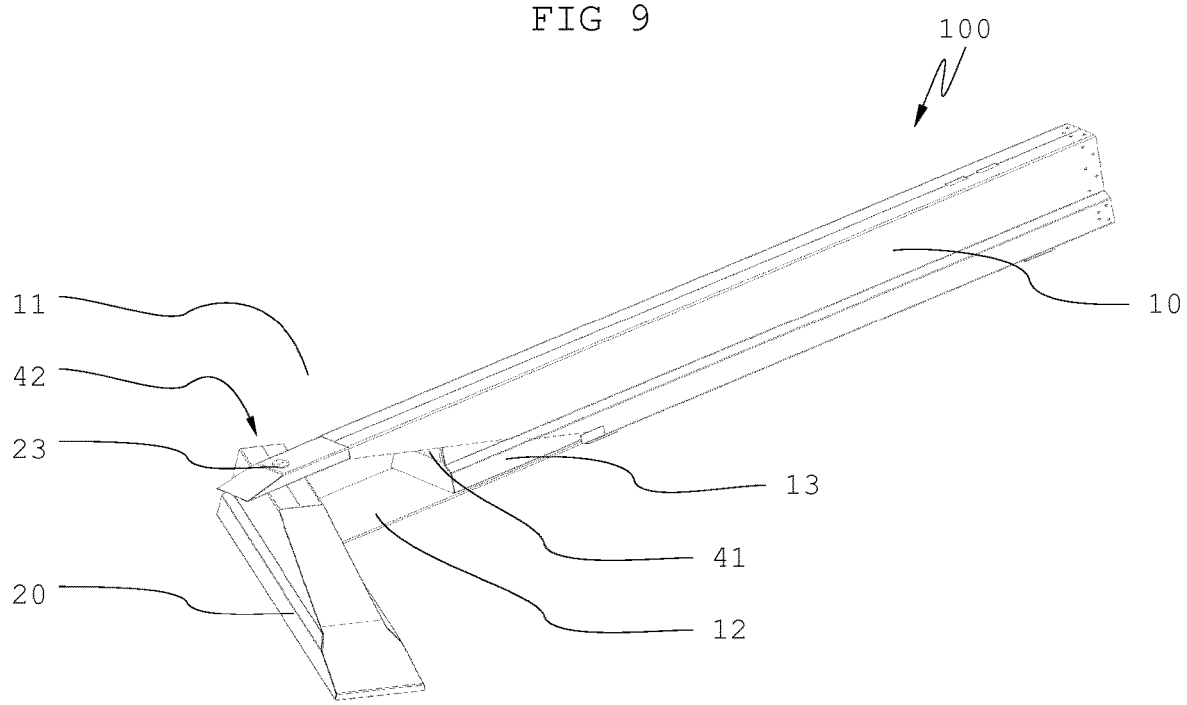
Figure 11:
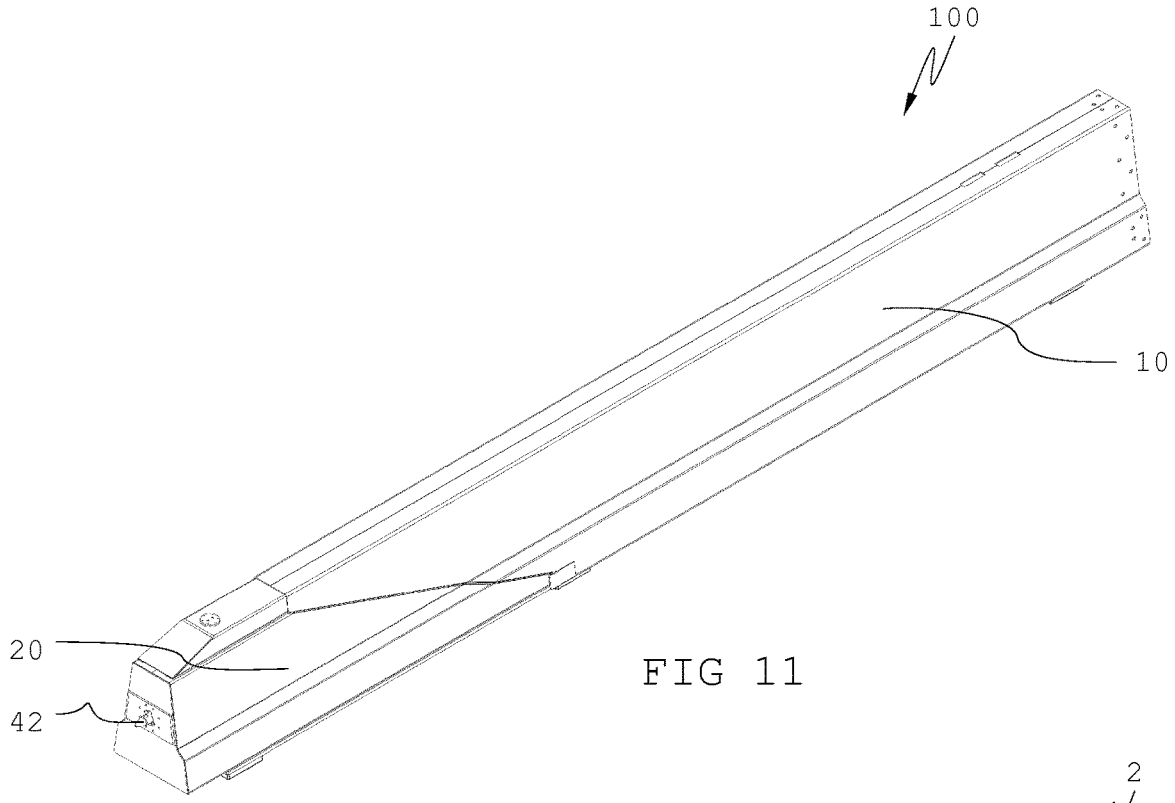
Figure 12:
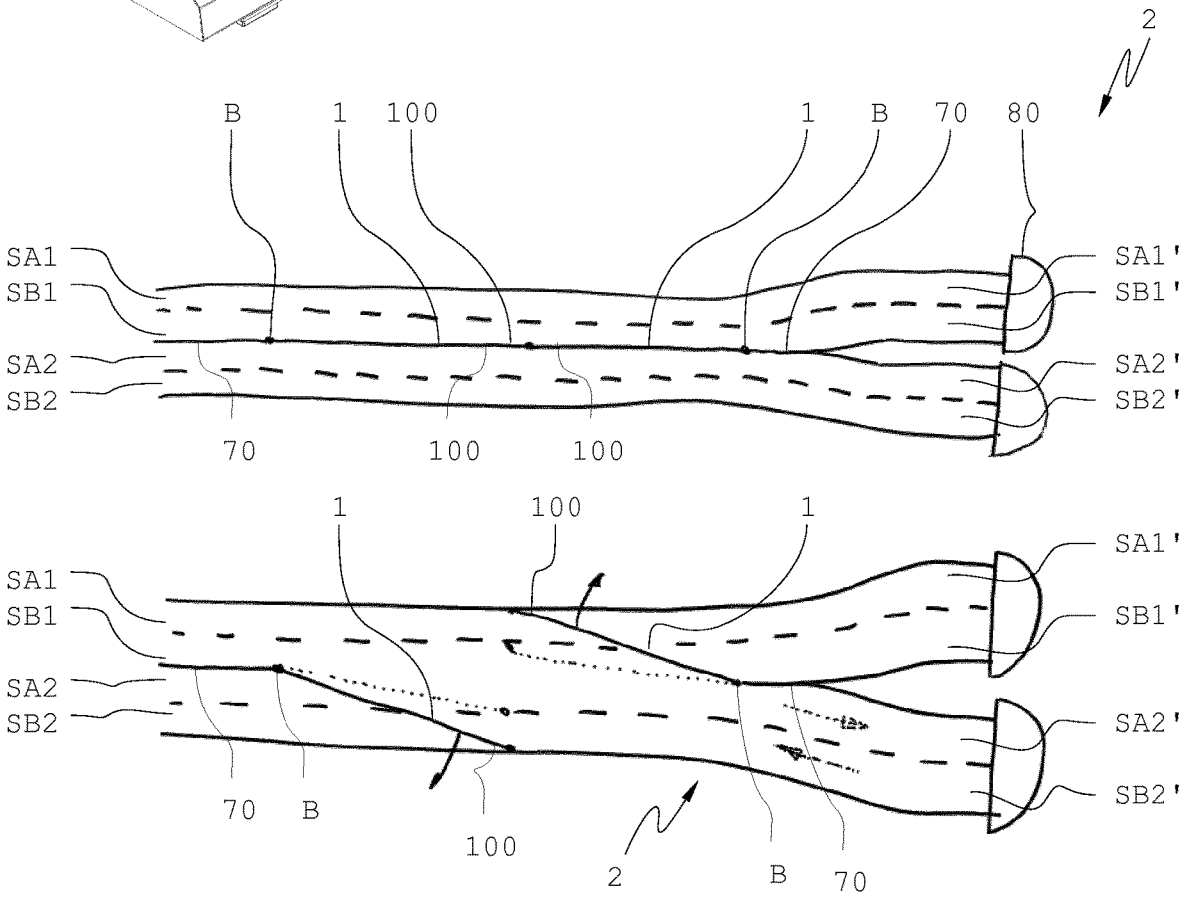

The invention is explained exemplarily by the following figures:

FIG. 1: A perspective representation of a terminal element;

FIG. 2: A front end view of the terminal element of FIG. 1;

FIG. 3: A perspective view of a terminal element according to FIG. 1 with partially hidden elements;

FIG. 4: A perspective view of a terminal element according to FIG. 1 with further hidden elements;

FIG. 5: A perspective view of the terminal element as shown in FIG. 1 during the rotation of the impact element;

FIG. 6: A side view of the terminal element from FIG. 4;

FIG. 7: A roadway boundary element;

FIG. 8: A transition system in two positions (FIG. 8*a* and FIG. 8*b*);

FIG. 9: A perspective representation of a further terminal element;

FIG. 10: A perspective view of the terminal element as shown in FIG. 9 during the rotation of the impact element;

FIG. 11: A perspective view of the terminal element according to FIG. 9 after the rotation of the impact element;

FIG. 12: An alternative arrangement of a transition system.

FIG. 1 shows a terminal element 100. The longitudinal axis L extends along or through the terminal element 100. The termination element 100 has a guiding element 10 and an impact element 20. The guiding element 10 has legs on one side, an upper leg 11 and a lower leg 12. The vertical axis of rotation A extends in the area of the front ends of the legs 11 and 12. An axis 23 is designed as the pivot. The impact element 20 is mounted on axis 23 so that it can be pivoted.

FIG. 2 shows the terminal element 100 from FIG. 1. A front end view is shown. The terminal element is in an intended position, i.e. it stands, for example, on a support S. For clarity, the vertical axis A, which extends vertically, is also shown. From the terminal element 100, the upper guide leg 11 and the lower guide leg 12 are visible. The impact element 20 is located between these two guide legs and a first element of a locking device, a locking bolt 41, is arranged essentially centrally in the impact element 20.

FIG. 3 shows a perspective view of the terminal element 100, whereby the upper leg 11 (see FIG. 1) of the guiding element 10 is hidden. Inside the upper leg 11 there is a traction drive 80 for pivoting the impact element 20 relative to the guiding element 10. The impact element 20 is pivotally mounted on the axis 23. It can be swiveled about the vertical axis A.

FIG. 4 also shows the terminal element 100 according to FIG. 1, whereby various elements of the terminal element 100 are hidden. A part of the guiding element 10 is hidden, a part of the impact element 20. The impact element 20 comprises an impact absorber 21, which in this case consists of several crumple elements 211 (only one is referenced). Some of these crumple elements 211 are also hidden. In this illustration, the impact absorber 21 is located within the guiding element 10, i.e. between the legs 11 and 12. A locking device 40 is shown on the front side of the impact element 20. A first element of the locking device 40, namely a cylinder 42, is shown. The cylinder 42 is arranged inside the impact element 20. In the rear area of the impact element 20, located inside the guiding element 10, there is a retaining device 50. The retaining device 50 comprises a retaining cylinder 52 which interacts with a retaining opening 51 of the retaining device 50. The retaining opening 51 is located in a plate inserted on the front side of the impact element 20. The reference symbol 81 indicates a drive for traction drive 80 (see FIG. 3). Within the guide element 10 there is also a hydraulic unit 30, with which, for example, the drive 81 for the traction drive 80 can be driven. The hydraulic unit 30 can also be used to operate the retaining device 50. The cylinder 42 can also be actuated via a hose system not shown here. The specialist is familiar with rotary couplings for hydraulic drives, which, for example, are arranged in the area of axis 23 in order to connect the hydraulic unit with the cylinder 42. For this reason, they have not been presented in detail.

FIG. 5 shows a perspective view of the terminal element 100 according to FIG. 1. FIG. 5 shows that the impact element 20 is swiveled about the axis 23. The impact absorber is now no longer inside or between the legs 11 and 12 of the guide element 10, it is swiveled. After the pivoting process (see, for example, FIG. 6), the impact absorber is located at front end of the terminal element 100.

FIG. 6 shows a side view of the terminal element 100, whereby the elements are designed as in the terminal element 100 according to FIG. 4. The impact element 20 is now in a 180° rotated position compared to the impact element 20 shown in FIGS. 1 to 3. The impact absorber 21 is thus arranged on the front end of the terminal element 100. The impact element 20 is still located between the upper and lower legs 11 and 12 of the guiding element 10. The cylinder 42 of the locking device and the retaining cylinder 52 are offset from each other. This makes it possible, for example, for the retaining cylinder 52 to engage in the impact element 20 next to the cylinder 42 of the locking device. However, it would also be conceivable to design the cylinder 42 of the locking device and the retaining cylinder 52 in such a way that these two cylinders can mesh with each other.

The hydraulic unit 30 is shown inside the guiding element 10. Like the impact element, the hydraulic unit 30 is also located between the legs 11 and 12 of the guiding element 10; in this case it is attached to the lower leg 12 of the guiding element 10. On the right side of the terminal element 100, the figure shows a damping element 60, which comprises a first and a second damper 61 and 62. The damping element is in operative connection with the legs 11 and 12. The upper leg 11 and the lower leg 12 are displaceably mounted within the guiding element 10. When a car collides with the impact element 20, the crumple elements 211 of the impact absorber 21 begin to deform. At the same time the dampers 61 and 62 begin to shorten and absorb additional energy. This means that the path to the reduction of energy is extended. However, it would also be conceivable to provide additional crumple elements 211 within the guiding element 10 instead of the dampers 61 and 62. It is also conceivable to provide only a single damper instead of the 61 or 62 dampers, which is essentially arranged centrally in relation to the height of the terminal element. It is conceivable to arrange the hydraulic unit in the direction from the impact element to the damper only after the damper.

FIG. 7 shows a traffic barrier device 1 with one terminal element 100, several unspecified intermediate elements and a stationary element 70. A second vertical axis of rotation B is provided on the stationary element 70, on which the terminal element 100 can be swiveled with the other intermediate elements.

FIGS. 8*a* and 8*b* show a transition system 2 comprising multiple traffic barrier devices 1. The transition system is designed as shown in PCT/EP 2017/050042. For shifting, a trolley is designed according to the trolley shown in PCT/EP 2017/050042. The transition system in FIG. 8*a* shows the condition prior to the operation of the transition system and FIG. 8*b* shows the condition after the operation of the transition system 2. The transition system 2 as shown in FIGS. 8*a* and 8*b* is designed to divert a four-lane roadway into a three-lane roadway. The four-lane roadway shown in FIG. 8*a* comprises lanes C, D, E and F. It may be necessary to divert lane E into lane D, for example. This is desirable, for example, depending on the volume of traffic. If, for example, traffic moves in the morning towards the city (here in the direction of the three lanes), it is advantageous if, for example, two lanes can be used in this direction. In the evening the situation is typically the other way round.

The transition system 2 has two traffic barrier devices 1 in each case. These are each mounted on a stationary element 70 on a second vertical axis of rotation (see FIG. 7). The traffic barrier device 1 has a terminal element 100 at each end. The terminal element 100 can be locked to another traffic barrier element by means of the locking device 40 (see, for example, FIG. 4). For example, the other traffic barrier elements have further/second elements of the locking device.

As can be seen from FIGS. 8*a* and 8*b*, a transition system 2 as described herein can be used to direct the middle lane of the three-lane side either to lane D or to lane E. The middle lane of the three-lane side can be directed either to lane D or to lane E using a transition system 2 as described here. This enables regulating or controlling the traffic.

FIG. 9 shows a perspective representation of a further terminal element 100, similar to the terminal element of FIG. 1. Same or similar elements are provided with the same reference signs. For a detailed description of the individual elements, please refer to FIG. 1.

In contrast to the terminal element according to FIG. 1, the terminal element 100 according to FIG. 9 has a turned-down terminal 24 instead of an impact absorber 21 (see FIG. 6). The terminal element 100 is shown in the rotated position (as shown in FIG. 6). In addition, the terminal element 100 has a bulkhead element 13, the function of which is explained with reference to the following figures. The bulkhead element 13 is displaceably arranged along the longitudinal axis L within the guiding element. The bulkhead element 13 has essentially the same outer contour as the guiding element. The bulkhead element 13 closes an opening which is created by twisting the impact element.

FIG. 10 shows a perspective view of the terminal element 100 as shown in FIG. 9 during the rotation of the impact element 20. The impact element 20 is mounted on the axis 23 so that it can rotate about the vertical axis A, as in FIG. 1, and is already partially rotated. To rotate the impact element, the terminal element 100 has the same means as described for FIG. 4. Before turning the impact element 20, the bulkhead element 13 is moved along the longitudinal axis L (FIG. 9). An opening within the guiding element, which essentially corresponds to the dimensions of the depression 24 (FIG. 9) of the impact element 20, is thus freed. The locking device consisting of the cylinder (see also FIG. 11) and the locking opening 41 is also formed on the impact element. The locking opening 41 is formed on the bulkhead element 13. The cylinder 42 is located on the impact element 20, as in the terminal element 100 of FIG. 1.

FIG. 11 is a perspective view of the terminal element 100 as shown in FIG. 9 after the rotation of the impact element 20. The impact element fills the opening which was opened by the bulkhead element 13 (FIG. 10). The cylinder 42 is visible at the front of the impact element 20. This cylinder can be used to create a connection with a further terminal element or a stationary arrangement. For this purpose, the additional terminal element or the stationary arrangement can have a locking opening.

FIG. 12 shows an alternative arrangement of a transition system 2. The transition system 2 comprises two traffic barrier devices 1 (see also FIG. 7). The transition system is arranged in front of a directionally separated tunnel with two tunnel tubes 80 (designated only once). Each tunnel is provided with one roadway with two lanes each, SA1 and SB1 as well as SA2 and SB2. At the tunnel entrance, these are each marked with a' for differentiation. The driving directions can be assumed in FIG. 12 in the upper roadway from SA1 and SB1 in the direction of SA1' and SB1' (normal traffic) and in the lower roadway from SA2' and SB2' in the direction of SA2 and SB2 (oncoming traffic).

The traffic barrier devices 1 are each connected to a stationary element 70 with a vertical axis of rotation B so that they can be rotated or pivoted (see also FIG. 7).

FIG. 12 (top) shows the transition system 2 in its original position, FIG. 12 (bottom) shows two possible end positions. In the original position, the traffic barrier devices with their terminal elements 100 are connected to each other at their ends. This means that impact elements 20 are in their closed position (see FIGS. 1 and 6) and are connected at their ends to bolting devices 42 (see FIGS. 4 and 6).

In the first end position (extended display) both tracks SA1 and SB1 are redirected to tracks SA2' and SB2'. The oncoming traffic originally on the tracks SA2' and SB2' is stopped or diverted, for example, before the second tunnel end not shown here. For this purpose, the respective traffic barrier devices 100 are swiveled over the entire lane so that they extend over both lanes SA1 and SB1, or SA2 and SB2, respectively, for each lane.

In the second or alternative end position, the traffic barrier devices 100 are only swiveled to the middle of the lane, i.e. only over one lane, namely SB1 and SA2. This way, traffic can be directed in both directions in one of the two tunnels. In a first step, a second tunnel end, not shown here, i.e. at the tunnel entrance for oncoming traffic, is actuated by a second transition system 2. The two lanes SA2' and SB2' are merged and led to the SB2' lane. This means that the oncoming traffic only arrives at the end of the tunnel shown in FIG. 12 on the SB2' lane, the SA2' lane remains free. For safe traffic guidance, the lanes SA1 and SB1 are directed to the individual lane SB1 in a next step and then directed to the lane SA2'. There is now oncoming traffic in the tunnel (dashed arrows).

The invention claimed is:

1. A terminal element of a traffic barrier device having a longitudinal axis comprising:

a guiding element, an impact element which can be rotated or pivoted relative to the guiding element from a closed position into an impact position, and the impact element being mounted on the guiding element so as to be rotatable or pivotable about a vertical axis, wherein the impact element has a connecting side, for connection to an adjacent traffic barrier device, and an impact side, for damping or repelling an impact, and the vertical axis being arranged between the connecting side and the impact side.

2. The terminal element according to claim 1, wherein the impact element extends along the longitudinal axis in the closed position and in the impact position.

3. The terminal element according to claim 1, wherein the impact element comprises at least a first element of a retaining device.

4. The terminal element according to claim 3, wherein the first element of the retaining device is designed as a retaining opening or as a retaining cylinder.

5. The terminal element according to claim 4, wherein a second element of the retaining device is arranged inside the guiding element.

6. The terminal element according claim 1, wherein the impact element comprises at least a first element of a locking device.

7. The terminal element according to claim 6, wherein the first element of the locking device is designed as a locking bolt or as a cylinder.

8. The terminal element according to claim 1, wherein the impact element comprises an impact damper arranged at the impact side.

9. The terminal element according to claim 8, wherein the impact absorber has a multi-part construction.

10. The terminal element according to claim 9, wherein the impact absorber comprises a plurality of crumple elements having different compression properties or a different working capacity.

11. The terminal element according to claim 6, wherein the first element of the locking device is arranged opposite of the impact absorber or a turned-down terminal with respect to the vertical axis.

12. The terminal element according to claim 1, wherein the guiding element has two guiding legs between which the impact element is arranged.

13. The terminal element according to claim 12, wherein the vertical axis extends between the guiding legs of the guiding element.

14. The terminal element according to claim 1, wherein the impact element is horizontally displaceable along the longitudinal axis of the terminal element.

15. The terminal element according to claim 1, wherein a damper is arranged between the impact element and the guiding element for damping a horizontal movement of the impact element.

16. A transition system comprising at least one traffic barrier device with a terminal element according to claim 1.

17. The transition system according to claim 16, wherein the traffic barrier device has a second vertical axis of rotation on a side remote from the terminal element for pivoting the traffic barrier device relative to a stationary element of the transition system.

18. A method for providing a collision protection on a terminal element of a traffic barrier device, wherein an impact element is pivoted about a vertical axis arranged on a guiding element, and after the pivoting of the impact element, the impact element is locked with a locking device to a further traffic barrier device by a locking device in such a way that the impact element is fixed under pre-stress.

19. The method according to claim 18, wherein the impact element is locked to the guiding element, after the pivoting of the impact element, by a retaining device in such a way that further pivoting of the impact element is prevented.

* * * * *